US005470245A

United States Patent [19]

Ichimura

[11] Patent Number: 5,470,245

[45] Date of Patent: Nov. 28, 1995

[54] ELECTRICAL CONNECTOR HAVING FLAT AND ELASTIC MULTI-CONTACT MEMBERS

[75] Inventor: Yoshiaki Ichimura, Tokyo, Japan

[73] Assignee: Japan Aviation Electronics Industry, Limited, Japan

[21] Appl. No.: 278,839

[22] Filed: Jul. 22, 1994

[30] Foreign Application Priority Data

Jul. 23, 1993 [JP] Japan ..... 5-040442 U

[51] Int. Cl.[6] ..... H01R 9/09

[52] U.S. Cl. ..... 439/259; 439/75

[58] Field of Search ..... 439/74, 75, 259, 439/261, 265, 266, 342

[56] References Cited

U.S. PATENT DOCUMENTS

| | | | |
|---|---|---|---|
| 4,540,229 | 9/1985 | Madden | 439/75 |
| 5,217,383 | 6/1993 | Hildebrandt | 439/259 |
| 5,415,559 | 5/1995 | Ichimura | 439/259 |

FOREIGN PATENT DOCUMENTS 1-42309 12/1989 Japan .

*Primary Examiner*—Neil Abrams

*Attorney, Agent, or Firm*—Laff, Whitesel, Conte & Saret, Ltd.

[57] ABSTRACT

In a connector for use in connection between a pair of connection objects opposite to each other, each having a number of contact holes arranged in rows and columns in a contact matrix, a plurality of flat and elastic multi-contact members are used for connecting contacts in the contact holes of one connection object with contacts in the contact holes of the other connection object. Each of the multi-contact members comprises a flexible and flat insulator sheet and conductive layers formed on opposite surfaces of the sheet. At least one of the conductive layers are separated into a plurality of conductive strips corresponding to contact holes in one row of the contact matrix. The conductive strips are fitted into contact holes in the corresponding row of contact matrix at opposite ends of each of the multi-contact members. When the connection objects are relatively moved in the direction perpendicular to the first direction and the rows, the opposite ends of the conductive strips are brought into press contact with contact elements in the contact holes due to elastic deformation of the multi-contact member. One of the conductive layers on the opposite surfaces of the sheet can be an integral film overlying the corresponding surface. In that case, one of two contact elements in each of contact holes is used as ground contact to be brought into contact with the integral film.

13 Claims, 5 Drawing Sheets

ELECTRICAL CONNECTOR HAVING FLAT AND ELASTIC MULTI-CONTACT MEMBERS

BACKGROUND OF THE INVENTION

This invention relates to a connector for use in electrically connecting a pair of connection objects opposite to each other in a first direction and, in particular, to a connector which can carry out connection and disconnection between the connection objects in accordance with a relative movement of the connection objects in a second direction perpendicular to the first direction.

For example, a conventional connector of the type is disclosed in Japanese Utility Model Publication No. 42309/1989 (JP(Y2) 1-42309). The connector is for electrically connecting two pin contacts to each other and includes an electroconductive socket contact. The socket contact has two socket portions each having a size that allows the pin contact to be loosely fitted or inserted thereinto, and a flexible elastic portion connecting these socket portions to each other.

Prior to electrical connection, the pin contacts are inserted into the respective socket portions. In this event, no special force is required for insertion of the contacts since each socket portion has such the size to allow the pin contact to be loosely inserted thereinto. Accordingly, the conventional connector will be called a zero-insertion force connector.

Then, two pin contacts are moved opposite to each other in a radial direction. The socket portions are brought into press contact with the pin contacts while the flexible elastic portions being elastically bent. As a result, two pin contacts are electrically connected to each other through the socket contact.

The above-mentioned connector uses the socket contact including two socket portions formed at opposite ends of the flexible elastic portion and, therefore, has a complicated structure. The use of socket contacts makes it difficult to assemble a high-density small-sized connector and reduces the productivity thereof.

In order to insure insertion of the pin contacts into the socket portions, a positioning member may be necessary to hold the socket portions at preselected positions. It is generally difficult to install the positioning member because of complicated structure of the socket portions. This will readily be understood in view of the fact that the connector disclosed in the above-mentioned publication comprises no positioning member. Accordingly, the socket portions may suffer from misalignment. In this event, the pin contacts fail to be correctly inserted into the socket portions.

In my copending U.S. patent application Ser. No. 08/063,017 filed on May 17, 1993, now U.S. Pat. No. 5,415,559 the present inventor proposed an improved electrical connector where socket contacts in connection objects and a flexible elastic pin contact for connecting the socket contacts are used in place of pin contacts in connection objects and the socket contact in the prior art. Further, positioning members are used for holding the pin contact at the preselected position. Thus, the connector is readily assembled and can make a correct connection. However, for the connection objects having a large number of socket contacts to be connected, the connector must be provided with a large number of pin contacts. This means that assembling of pin contacts into the connector is complex. Further, high density of contacts is restricted by use of solid pin contacts.

SUMMARY OF THE INVENTION

Therefore, it is an object of the present invention to provide an electrical connector which has a small size and a number of contacts at a high density and is readily in production.

The present invention can be applied to an electrical connector for use in electrically connecting a pair of connection objects to each other, the connection objects being opposite to each other in a first direction and having a relative position changeable between a first and a second position in a second direction perpendicular to the first direction, each of the connection objects having a plurality of holes formed therein each extending in the first direction and having electroconductive contact means therein, the plurality of holes being arranged in a third direction perpendicular to the first direction and the second direction to form a row of holes. The connector comprises a flat and elastic multi-contact member comprising a flat insulator sheet generally extending in the first direction and a plurality of parallel conductive strips formed on the flat insulator sheet and extending in parallel with each other in the first direction, the multi-contact member having opposite end portions, each of the end portions being separated into a plurality of tab portions spaced from each other in the third direction and corresponding to the plurality of conductive strips, the a plurality of tabs being loosely fitted into the plurality of holes, respectively, in each of the connection objects when the relative position is the first position, each of the tabs being brought into press contact with the contact means in the corresponding one of the holes at two different points which are on opposite surfaces and spaced from each other in the first direction while the multi-contact member being elastically bent when the relative position is the second position.

In one aspect of the present invention, each of the contact means in each of the holes is separated in the second direction into two contact pieces. In addition to the conductive strips as a first conductive layer, the multi-contact member further comprises a second conductive layer formed on an opposite surface of the flat insulator sheet.

According to another aspect of the present invention, the second conductive layer is separated in the second direction into a plurality of conductive strips in registry with the first conductive strips. The second conductive layer may be formed to overlie the entire surface of the opposite surface.

According to another aspect of the present invention, the electric connector further comprises a pair of insulator housings opposite to each other in the first direction and relatively movable in the second direction, each of the housings having a positioning slot for receiving each one of generally half portions of the multi-contact member in the first direction.

A preferred embodiment of the present invention is directed to an electric connector for use in electrically connecting a pair of connection objects to each other, the connection objects being opposite to each other in a first direction and having a relative position changeable between a first and a second position in a second direction perpendicular to the first direction, each of the connection objects having a plurality of holes formed therein each extending in the first direction and having electroconductive contact means therein, the plurality of holes being arranged in columns and row of a matrix pattern, each of columns extending the second direction and each of rows extending a third direction perpendicular to the first direction and the second direction. The connector comprising a plurality of flat and elastic multi-contact members disposed with spaces left between adjacent ones in the second direction and being corresponding to those between adjacent rows, each of the multi-contact members being disposed in a plane extending in the first direction and the third direction, each of the multi-contact members comprising a flat insulator sheet generally extending in the first direction and a plurality of parallel conductive strips formed on the flat insulator sheet and extending in parallel with each other in the first direction, each of the multi-contact member having opposite end portions, each of the end portions being separated into a plurality of tab portions spaced from each other in the third direction and corresponding to the plurality of conductive strips, the a plurality of tab portions of each of the multi-contact members being loosely fitted into the plurality of holes in the corresponding one of the rows, respectively, in each of the connection objects when the relative position is the first position, each of the tab portions being brought into press contact with the contact means in the corresponding one of the holes at two different points which are on opposite surfaces and spaced from each other in the first direction when the relative position is the second position; and a pair of insulator housings opposite to each other in the first direction and relatively movable in the second direction, each of the housings having a plurality of positioning slots extending in parallel with each other and in the third direction for receiving each of the multi-contact members in proximity of each of the opposite end potions.

The conductive layer on the multi-contact member is made of conductive and elastic material such as phosphorus bronze, beryllium copper, and stainless steel, so that the multi-contact member is insured to have the elasticity.

DESCRIPTION OF PREFERRED EMBODIMENTS

Figure 1:
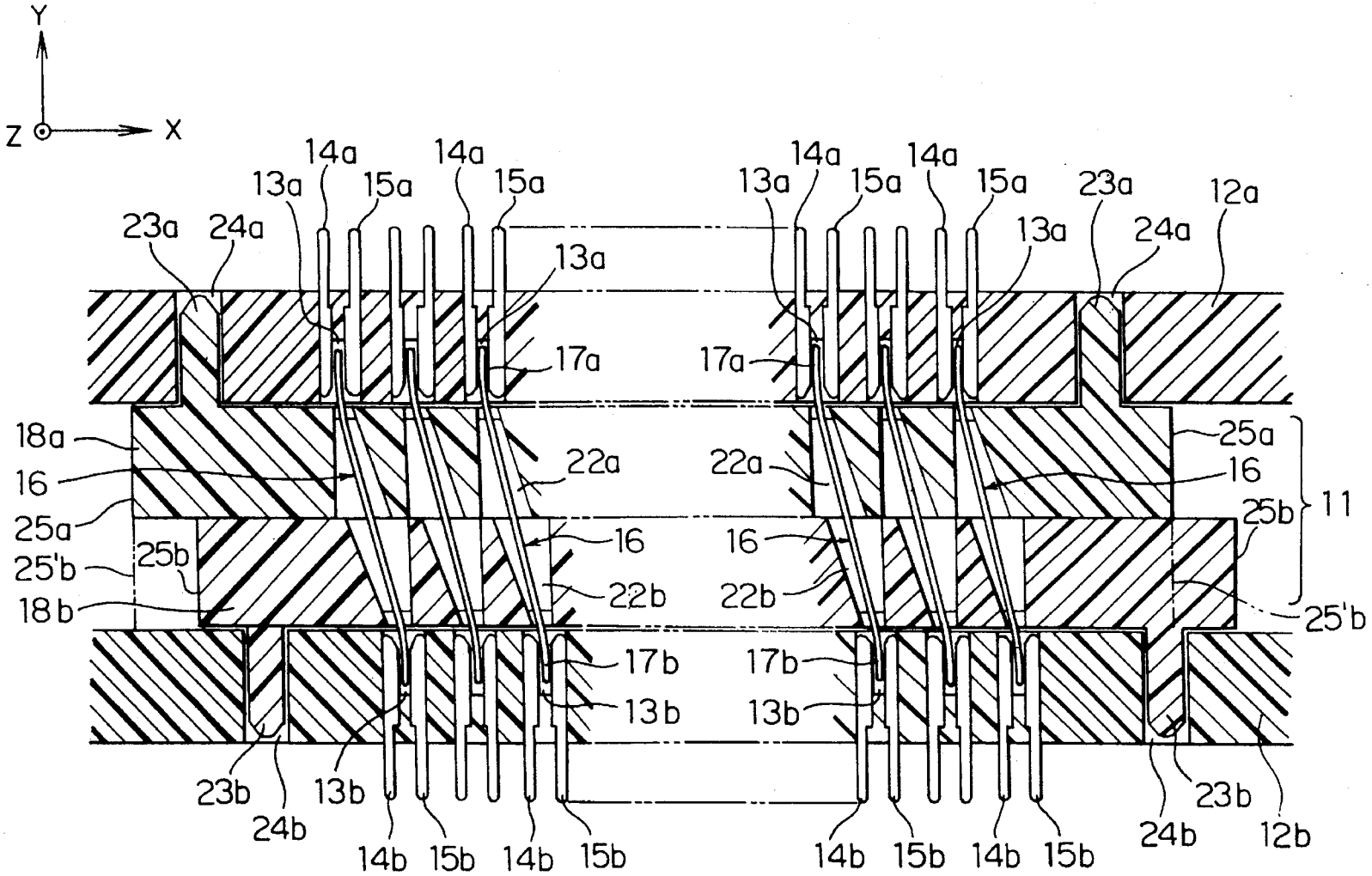
FIG. 1 is a cross-sectional view of an electrical connector according to one embodiment of the present invention shown together with a pair of connection objects.
Figure 2:
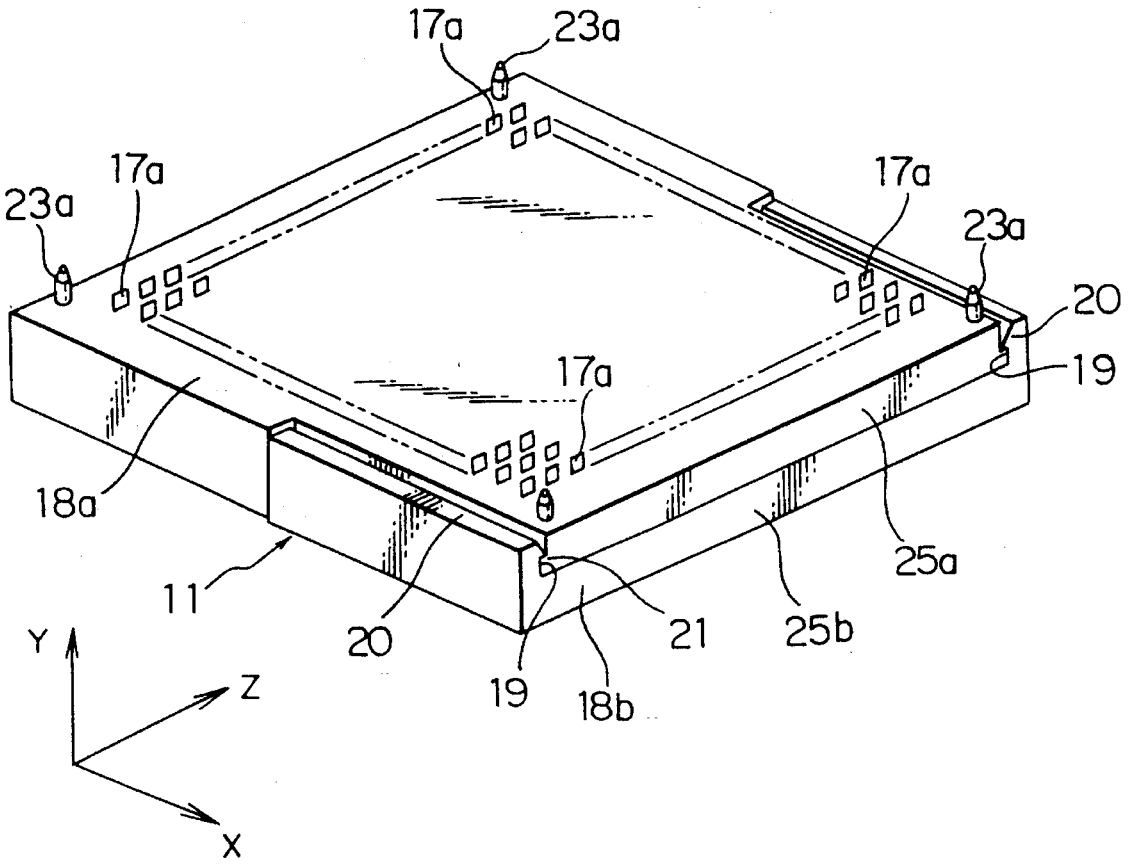
FIG. 2 is a perspective view of the connector.
Figure 3:
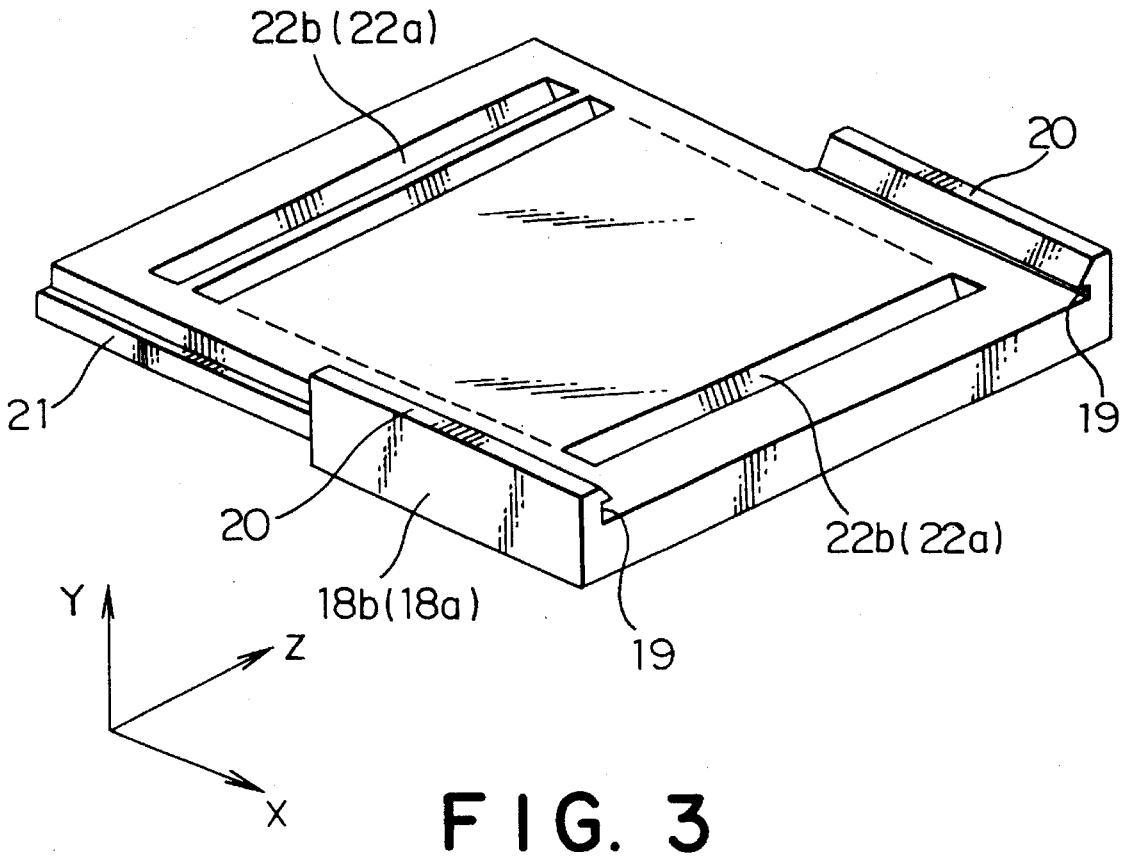
FIG. 3 is a perspective view of one of pair of positioning member used in the connector of FIG. 1.

Referring to FIGS. 1, 2 and 3, an electrical connector 11 according to a preferred embodiment of the present invention shown therein is for use in electrically connecting a pair of connection objects 12*a* and 12*b* (see FIG. 1) to each other. The connection objects 12*a* and 12*b* are, for example, printed boards, LSI, and others.

The connection objects 12*a* and 12*b* are opposite to each other in a first direction (Y direction) and have a relative position changeable between a first and a second position in a second direction (X direction) perpendicular to the first direction Y. In FIG. 1, the relative position of the connection objects 12*a* and 12*b* is the second position.

Each of the connection objects 12*a* and 12*b* has a plurality of holes 13 formed to extend in the first direction Y therein. Holes 13 in connection objects 12*a* and 12*b* are denoted with suffixes "a" and "b" as 13*a* and 13*b*, respectively. Each of the holes has electroconductive contact means which may be made of an electroconductive film coated on the inner surface of the hole, a socket contact fitted thereinto. In the shown embodiment, each of the contact means comprises two contact pieces separated in the second direction X, that is, the two contact pieces are shown as two pin contacts 14 and 15 of a plate type or a rod type fitted in each of the holes, which are shown with suffixes "a" and "b" for connection objects 12*a* and 12*b*.

In each of connection objects 12*a* and 12*b*, the plurality of holes 13*a* and 13*b* are arranged in columns and rows of a matrix pattern. Each of columns extends in the second direction X and each of rows extends in a third direction Z perpendicular to the first direction Y and the second direction X.

The connector 11 comprises a plurality of flat and elastic multi-contact members 16 disposed with spaces left between adjacent ones in the second direction X. The spaces are corresponding to those between adjacent rows of the holes 13. Each of the multi-contact members 16 is disposed in a plane extending in the first direction Y and the third direction Z. Each of the multi-contact members 16 has opposite end portions in the first direction Y and each of the end portions is separated into a plurality of tab portions 17*a* and 17*b* spaced from each other in the third direction Z. Separation of tab portions 17*a* are clearly shown in FIG. 2. The tab portions 17*a* and 17*b* are loosely fitted into holes 13*a* and 13*b* in the connection objects 12*a* and 12*b*, respectively. The multi-contact member 16 will later be described in detail in connection with FIGS. 4–7.

The connector 11 further comprises a pair of insulator housings 18*a* and 18*b* opposite to each other in the first direction Y and relatively movable in the second direction X.

As shown in FIGS. 2 and 3 in detail, each of housings 18*a* and 18*b* is a generally rectangle plate and has an guide grooves 19 in upstanding walls 20 from its upper surface at half portions of opposite sides thereof. Ribs 21 are formed at other half portions at opposite side surfaces of each of the housings 18*a* and 18*b*. Two housings 18*a* and 18*b* are superposed in a reverse symmetrical condition and are combined with each other to be telescopically moved in the second direction X. In detail, the ribs 21 of each one of housings 18*a* and 18*b* are slidably fitted into guide grooves 19 in the other one of the housings 18*a* and 18*b* so that two housings 18*a* and 18*b* are relatively movable in the second direction X.

As shown in FIGS. 1 and 3, each of the housings 18*a* and 18*b* has a plurality of positioning slots 22*a* and 22*b* extending in the third direction Z and along rows of holes 13, respectively. Each of the positioning slots is for receiving each one of half portions of the multi-contact members 16 in the first direction Y.

As shown in FIGS. 1 and 2, each of housings 18*a* and 18*b* is provided with a plurality of projections 23*a* and 23*b* upstanding on one surface thereof. That is, the upper housing 18*a* in the first direction Y has four projections 23*a* at four corners on the top surface, while the lower housing 18*b* also has four projections 23*b* on the bottom surface thereof. The connection objects 12*a* and 12*b* are provided with engagement holes 24*a* and 24*b* for engaging projections 23*a* and 23*b*, respectively. As a result, the housings 18*a* and 18*b* can be moved together with the connection objects 12*a* and 12*b*, respectively, in the first direction X.

As described above, the connection objects 12*a* and 12*b* are positioned at the second relative position in the second direction X. In the second position, opposite ends 25*a* of the housing 18*a* are offset from the opposite ends 25*b* of the other housing 18*b* in the second direction X by a predetermined distance. At the first position, opposite ends 25*a* of the housing 18*a* are in registry with the opposite ends 25*b* of the other housing 18*b*, as shown in FIG. 2 and as shown in FIG. 1 by an imaginary line 25'*b*. In the first position, holes 13*b* of the lower connection object 12*b* (in FIG. 1) are just under holes 13*a* of the upper connection object 12*a*, respectively, in the first direction Y, and each of the positioning slots 22*a* of the upper housing 18*a* is arranged just above the corresponding one of positioning slots 22*b* of the lower housing 18*b* in the first direction Y. Thus, each of the multi-contact members 16 is in a plane extending in the first direction Y and the third direction Z.

Figure 4:
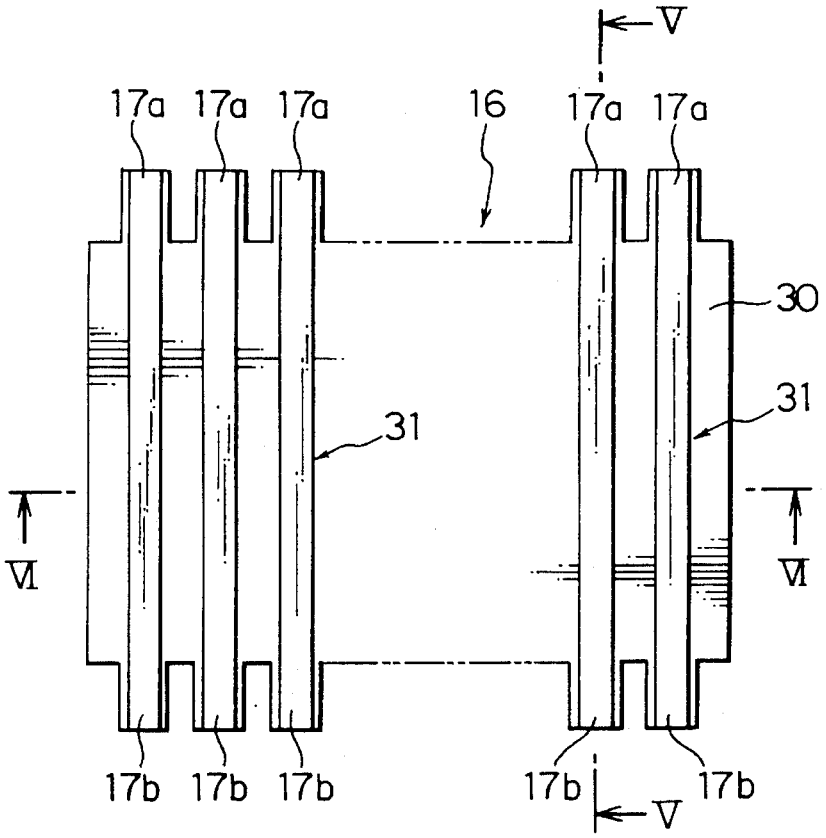
FIG. 4 is a front view of a multi-contact member used in the connector of FIG. 1.
Figure 5:
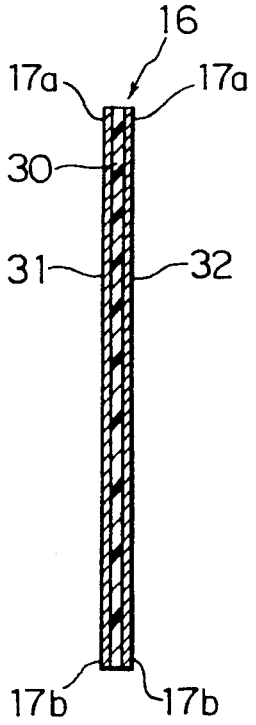
FIG. 5 is a sectional view the multi-contact member taken along a line V—V in FIG. 4.
Figure 6:
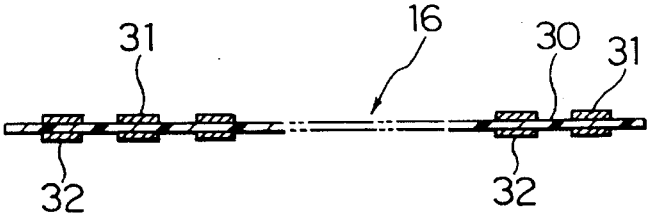
FIG. 6 is a sectional view the multi-contact member taken along a line VI—VI in FIG. 4.

Referring to FIGS. 4–6, each of the multi-contact members 16 comprises a flat flexible insulator sheet 30 generally extending in the first direction Y and a plurality of parallel conductive strips 31 formed on one surface of the flat insulator sheet 30 and extending in parallel with each other in the first direction Y. The strips 31 are spaced between adjacent ones by a space equal to that between adjacent ones of the holes 13 arranged in each of the columns. As described above, each of the multi-contact members 16 has opposite end portions in the first direction Y. Each of the end portions in separated into a plurality of tab portions 17*a* and 17*b* in the third direction Z. The tab portions 17*a* and 17*b* are corresponding to the conductive strips 31.

Figure 7:
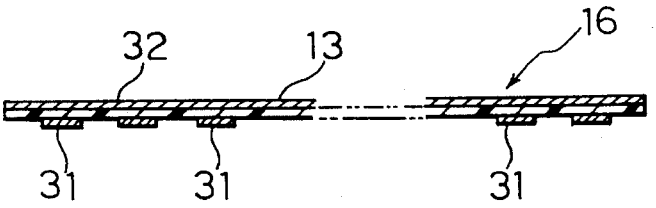
FIG. 7 is a sectional view of another example of the multi-contact member similar to FIG. 6.

According to a desired example, in addition to the conductive strips 31 as a first conductive layer, the multi-contact member 16 further comprises a second conductive layer 32 formed on an opposite surface of the flat insulator sheet 30, as shown in FIG. 5. The second conductive layer 32 is a plurality of conductive strips separated in the second direction and in registry with the first conductive strips 31, as shown in FIG. 6. In another example, the second conductive layer 32 may be formed as an integral body to overlie the entire surface of the opposite surface, as shown in FIG. 7.

The conductive layers such as strips 31 and 32 is made of conductive and elastic material, for example, phosphorus bronze, beryllium copper, stainless steel, and others. Thus, the multi-contact member has elasticity.

Figure 8:
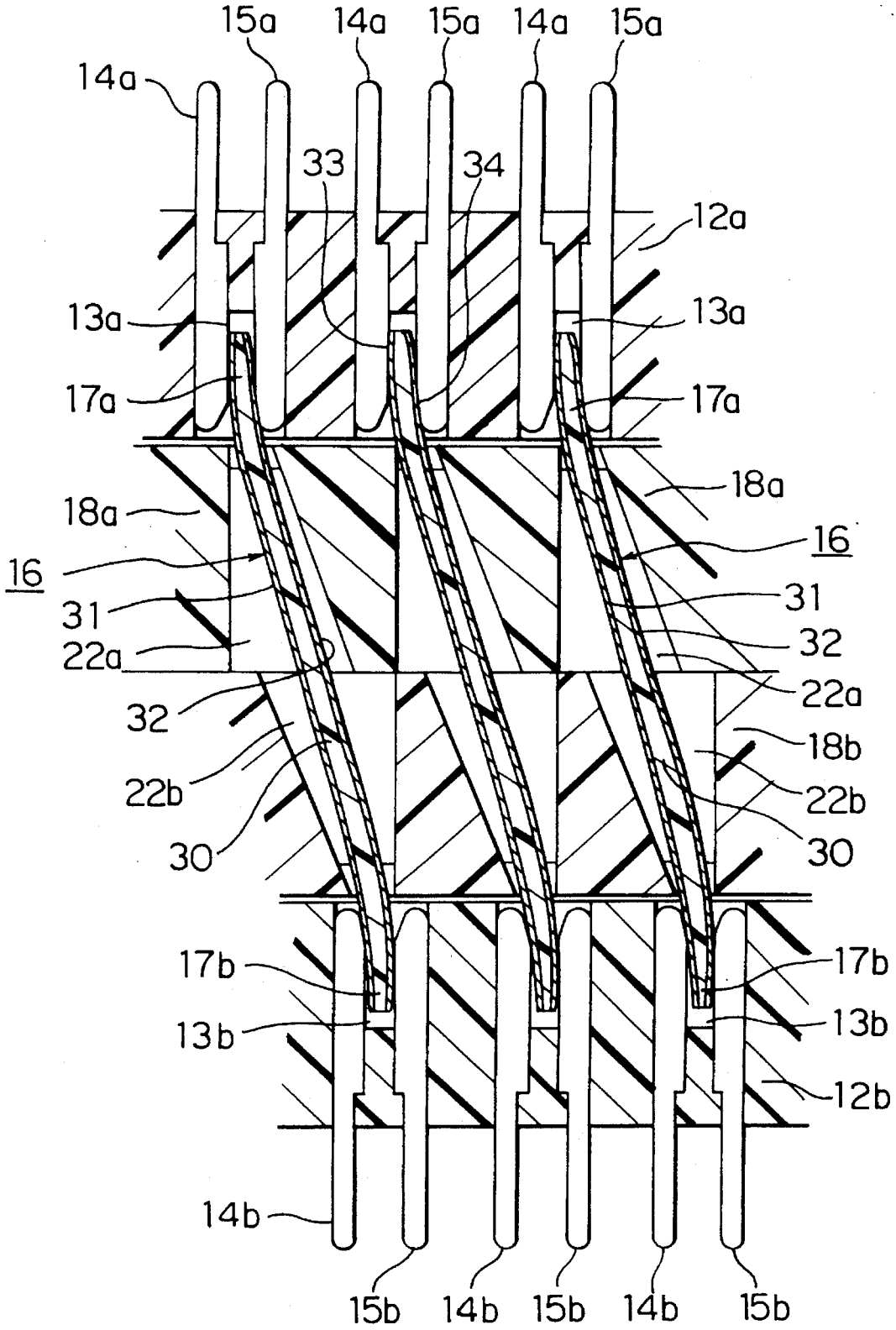
FIG. 8 is an enlarged cross-sectional view of the connector shown together with a pair of connection objects.

A plurality of the multi-contact members 16 are inserted into positioning slots 22*a* and 22*b* of the housings 18*a* and 18*b* superposed together and tab portions 17*a* and 17*b* at opposite end portions project out of the housings 18*a* and 18*b*, respectively, as shown in FIGS. 1 and 8. It is shown in FIG. 2 that the tab portions 17*a* project from the upper housing 18*a* and are arranged in columns and rows of a matrix.

In the embodiment shown in FIGS. 1 and 2, each of slots 22*a* and 22*b* is a groove having a bottom wall. The bottom wall has a plurality of holes through which tabs 17*a* and 17*b* are projected from each of the housings 18*a* and 18*b*.

Referring to FIG. 1, when the connection objects 12*a* and 12*b* are positioned at the first relative position so that the housings 18*a* and 18*b* are also positioned at the first relative position as shown by the imaginary lines 25'*b*, the holes 13*a* and 13*b* and slots 22*a* and 22*b* are linearly arranged in the first direction Y so that each of the multi-contact members 16 is in a plane extending in the first direction Y and the third direction Z, as described above. Accordingly, the tab portions 17*a* and 17*b* of each of the multi-contact members 16 are loosely inserted or fitted into the plurality of holes 13*a* and 13*b* in the corresponding one of the rows, respectively, in each of the connection objects 12*a* and 12*b*. When the relative position of the connection objects 12*a* and 12*b* is changed from the first position to the second position as shown in FIG. 8, each of the multi-contact members 16 is elastically bent and each of the tab portions 17*a* and 17*b* is brought into press contact with the pin contacts 14 and 15 in the corresponding one of the holes 13 at two different points, as shown at 33 and 34 for one tab portions at the upper center in the figure, which are on opposite surfaces and spaced from each other in the first direction Y. Thus, each of the conductive strips 31 on one surface of each multi-contact members 16 is insured to come into contact with pin contacts 14*a* and 14*b* in the corresponding holes 13*a* and 13*b* in the connection objects 12*a* and 12*b*, so that the contacts 14*a* and 14*b* are electrically connected through the conductive strip 31. In the similar manner, pin contacts 15*a* and 15*b* in the corresponding holes 13*a* and 13*b* of the connection objects 12*a* and 12*b* are electrically connected to each other through each of conductive strips 32 on the opposite surface of each multi-contact member 16. Thus, independent electrical connection can be realized at opposite surfaces of the thin multi-contact member 16. This means reduction of size of the connector with a high contact density.

In one modification, contacts 14 and 15 in one hole 13 can be connected together to form one contact part to which the opposite conductive strips 31 and 32 are commonly connected.

In another modification, the multi-contact member 16 can be made to have conductive strips 31 on only one surface. In the case, it is natural that a single contact may be disposed in each of the holes 13.

When the conductor 32 on one surface is integral to overlie the insulator sheet 30 as shown in FIG. 7, contacts 15 in holes 13 in one row are commonly connected and can be used as the ground to improve the high frequency properties.

What is claimed is:

1. An electrical connector for use in electrically connecting a pair of connection objects to each other, said connection objects being opposite to each other in a first direction and having a relative position changeable between a first and a second position in a second direction perpendicular to said first direction, each of said connection objects having a plurality of holes formed therein each extending in said first direction and having electroconductive contact means therein, said plurality of holes being arranged in a third direction perpendicular to said first direction and said second direction to form a row of holes, said connector comprising:

a flat and elastic multi-contact member comprising a flat insulator sheet generally extending in said first direction and a plurality of parallel conductive strips formed on said flat insulator sheet and extending in parallel with each other in said first direction, said multi-contact member having opposite end portions, each of the end portions being separated into a plurality of tab portions spaced from each other in said third direction and corresponding to said plurality of conductive strips, said a plurality of tabs being loosely fitted into said plurality of holes, respectively, in each of said connection objects when said relative position is said first position, each of said tabs being brought into press contact with said contact means in the corresponding one of said holes at two different points which are on opposite surfaces and spaced from each other in said first direction while the multi-contact member is being elastically bent when said relative position is said second position.

2. An electrical connector as claimed in claim 1, each of said contact means in each of said holes being separated in said second direction into two contact pieces, wherein, in addition to said conductive strips as a first conductive layer, said multi-contact member further comprises a second conductive layer formed on an opposite surface of said flat insulator sheet.

3. An electrical connector as claimed in claim 2, wherein said second conductive layer is separated in said second direction into a plurality of conductive strips in registry with said first conductive strips.

4. An electrical connector as claimed in claim 2, wherein said second conductive layer overlies the entire surface of said opposite surface.

5. An electric connector as claimed in claim 1, wherein said conductive strips is made of conductive and elastic material.

6. An electric connector as claimed in claim 5, where said conductive and elastic and material is one of phosphorus bronze, beryllium copper, and stainless steel.

7. An electric connector as claimed in claim 1, which further comprises a pair of insulator housings opposite to each other in said first and direction and relatively movable in said second direction, each of said housings having a positioning slot for receiving each one of generally half portions of said multi-contact member in the first direction.

8. An electric connector for use in electrically connecting a pair of connection objects to each other, said connection objects being opposite to each other in a first direction and having a relative position changeable between a first and a second position in a second direction perpendicular to said first direction, each of said connection objects having a plurality of holes formed therein each extending in said first direction and having electroconductive contact means therein, said plurality of holes being arranged in columns and row of a matrix pattern, each of columns extending said second direction and each of rows extending a third direction perpendicular to said first direction and said second direction, said connector comprising:

a plurality of flat and elastic multi-contact members disposed with spaces left between adjacent ones in said second direction and being corresponding to those between adjacent rows, each of said multi-contact members being disposed in a plane extending in said first direction and said third direction, each of said multi-contact members comprising a flat insulator sheet generally extending in said first direction and a plurality of parallel conductive strips formed on said flat insulator sheet and extending in parallel with each other in said first direction, each of said multi-contact member having opposite end portions, each of the end portions being separated into a plurality of tab portions spaced from each other in said third direction and corresponding to said plurality of conductive strips, said a plurality of tab portions of each of said multi-contact members being loosely fitted into said plurality of holes in the corresponding one of said rows, respectively, in each of said connection objects when said relative position is said first position, each of said tab portions being brought into press contact with said contact means in the corresponding one of said holes at two different points which are on opposite surfaces and spaced from each other in said first direction while each of multi-contact members are being elastically bent when said relative position is said second position; and a pair of insulator housings opposite to each other in said first direction and relatively movable in said second direction, each of said housings having a plurality of positioning slots extending in parallel with each other and in said third direction for receiving each of said multi-contact members in proximity of each of said opposite end potions.

9. An electrical connector as claimed in claim 8, each of said contact means in each of said holes being separated in said second direction into two contact pieces, wherein, in addition to said conductive strips as a first conductive layer, each of said multi-contact members further comprises a second conductive layer formed on an opposite surface of said flat insulator sheet.

10. An electrical connector as claimed in claim 9, wherein said second conductive layer is separated in said second direction into a plurality of conductive strips in registry with said first conductive strips.

11. An electrical connector as claimed in claim 9, wherein said second conductive layer overlies the entire surface of said opposite surface.

12. An electric connector as claimed in claim 8, wherein said conductive strips are made of conductive and elastic material.

13. An electric connector as claimed in claim 12, wherein said conductive and elastic material is one of phosphorus bronze, beryllium copper, and stainless steel.

* * * * *